US006382993B1

(12) United States Patent
Chen

(10) Patent No.: US 6,382,993 B1
(45) Date of Patent: May 7, 2002

(54) CARD CONNECTOR WITH RELIABLE TERMINAL MOUNTING STRUCTURE

(75) Inventor: Ming-Ching Chen, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/827,631

(22) Filed: Apr. 6, 2001

(51) Int. Cl.[7] ..... H01R 13/62
(52) U.S. Cl. ..... 439/157; 439/188; 439/260
(58) Field of Search ..... 439/157, 159, 439/160, 188, 489, 259, 260, 630, 631

(56) References Cited

U.S. PATENT DOCUMENTS 6,004,155 A * 12/1999 Wu ..... 439/188
6,039,599 A * 3/2000 Benjamin et al. ..... 439/630
6,132,229 A * 10/2000 Wu ..... 439/188
6,227,879 B1 * 5/2001 Dong ..... 439/159

* cited by examiner

*Primary Examiner*—Hien Vu
(74) *Attorney, Agent, or Firm*—Wei Te Chung

(57) ABSTRACT

A card connector includes a transverse base (20), a number of terminals (50) mounted in the transverse base, a longitudinal base (30), and a shell (10) shielding the bases and the terminals. Each terminal includes a planar mounting portion (503) molded in the transverse base, a contact portion (505) projecting into a card-receiving cavity (110) for being horizontally exerted on by a card (not shown) curing its insertion, and a tail portion (501) surface mounted to a printed circuit board (70). At least one of the terminals has a dip leg (504) projecting upwardly from the mounting portion and out of the transverse base for being secured to the printed circuit board (70).

1 Claim, 4 Drawing Sheets

CARD CONNECTOR WITH RELIABLE TERMINAL MOUNTING STRUCTURE

FIELD OF THE INVENTION

The present invention generally relates to a card connector, and more particularly to a card connector with reliable surface mounting structure.

BACKGROUND OF THE INVENTION

Electrical cards are widely used in electrical devices for storing information. A card connector is used for interconnecting the electrical card with an electrical device or an electronic component. A related conventional card connector is disclosed in Japanese Patent Application Publication No. 11066247. The card connector includes a housing and a plurality of terminals received in the housing. The housing has a card-receiving recess and a plurality of terminals receiving channels. Each of the terminals includes a mounting portion retained in the channels, a contacting portion extending into the card-receiving recess for electrically contacting a card, and a tail portion for being surface mounted to a printed circuit board (PCB).

However, the card inserted into or withdrawn from the card connector will exert forces on the contacting portions of the terminals along the card-insertion direction. Since the portion of the housing which securely receives the terminals is resilient in nature, the forces will be transferred to the tail portions of the terminals, subjecting the tail portion surfaces mounted on the PCB to a great portion of the force encountered during insertion and withdrawal of the card. Under such circumstances, the surface mounting structure is easy to break down after repeated use.

Hence, a reliable surface mounting, structure is needed to overcome the foregoing problems.

BRIEF SUMMARY OF THE INVENTION

A main object of the present invention is to provide a card connector with reliable terminal mounting structure.

Another object of the present invention is to provide a low profile card connector.

The card connector according to the present invention includes a shell, a transverse base mounted in the shell, and a plurality of terminals molded in the transverse base. The shell defines a card-receiving cavity for receiving a card therein. Each terminal includes a planar mounting portion molded in the transverse base, a contact portion projecting into the card-receiving cavity for being horizontally exerted on by the card during its insertion, and a tail portion for being surface mounted to a circuit board. At least one of the terminals has a dip leg projecting out of the transverse base for being secured to the printed circuit. The card connector further has an ejector to facilitate an ejection of a card and a write-protect switch contact and a full-insertion switch contact to respectively detect write-protect and full-insertion of the card.

Other objects, advantages and novel feather of the invention will become more apparent from the following detailed description when taken in conjunction with the accompanying drawings.

DETAILED DESCRIPTION OF THE INVENTION

Figure 1:
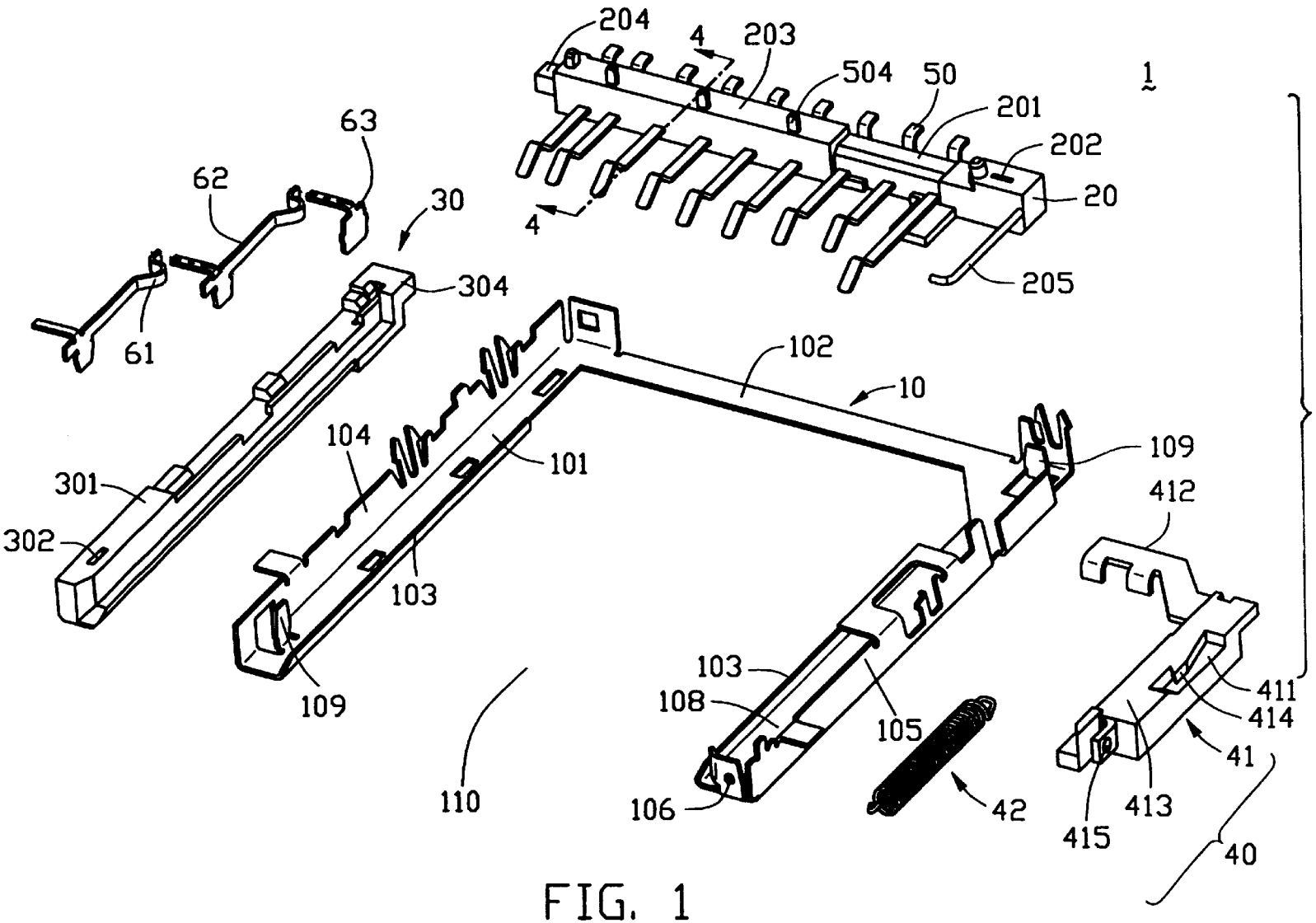
FIG. 1 is an exploded view of a card connector according to the present invention.

Referring to FIG. 1, a card connector 1 according to the present invention includes a transverse base 20, a plurality of terminals 50 molded with the transverse base 20, a longitudinal base 30, and a shell 10 shielding the bases 20, 30 and the terminals 50. A number of switch contacts 61, 62, 63 are mounted in the longitudinal base 30 for detecting write protect of a card (not shown) and full insertion of the card, respectively. An ejector 40 is slidably mounted in the shell 10 for facilitating ejection of the card from the connector 1.

The transverse base 20 is molded with the terminals 50 and includes a body portion 203. A substantially rectangular indentation 201 is defined in a top surface of the body portion 203. A first slit 202 is defined near the indentation 201. A protrusion 204 protrudes laterally from a side of the body portion 203. An L-shaped latching leg 205 extends forwardly from an opposite side of the body portion 203.

The longitudinal base 30 has a main body 301. A second slit 302 is defined in a front portion of the main body 301. A strap 304 extends from a rear end to join to the protrusion 204 of the transverse base 20.

The shell 10 includes a U-shaped frame 102 and a card-receiving cavity 110 for receiving the card. Each of two side arms of the U-shaped frame 102 has an elongated flange 103 upwardly projecting from an inner edge thereof. A mounting side wall 104 and an ejecting side wall 105 respectively project upwardly from outer edges of side arms of the frame 102. Thus a mounting channel 101 is defined between one flange 103 and the mounting side wall 104. An ejection channel 108 is defined between the other flange 103 and the ejecting side wall 105. Two hooks 109 are diagonally distributed and project upwardly from the frame 102 to engage with the first and the second slits 201, 302 for securing the insulating bases 20, 30 to the shell 10.

Figure 2:
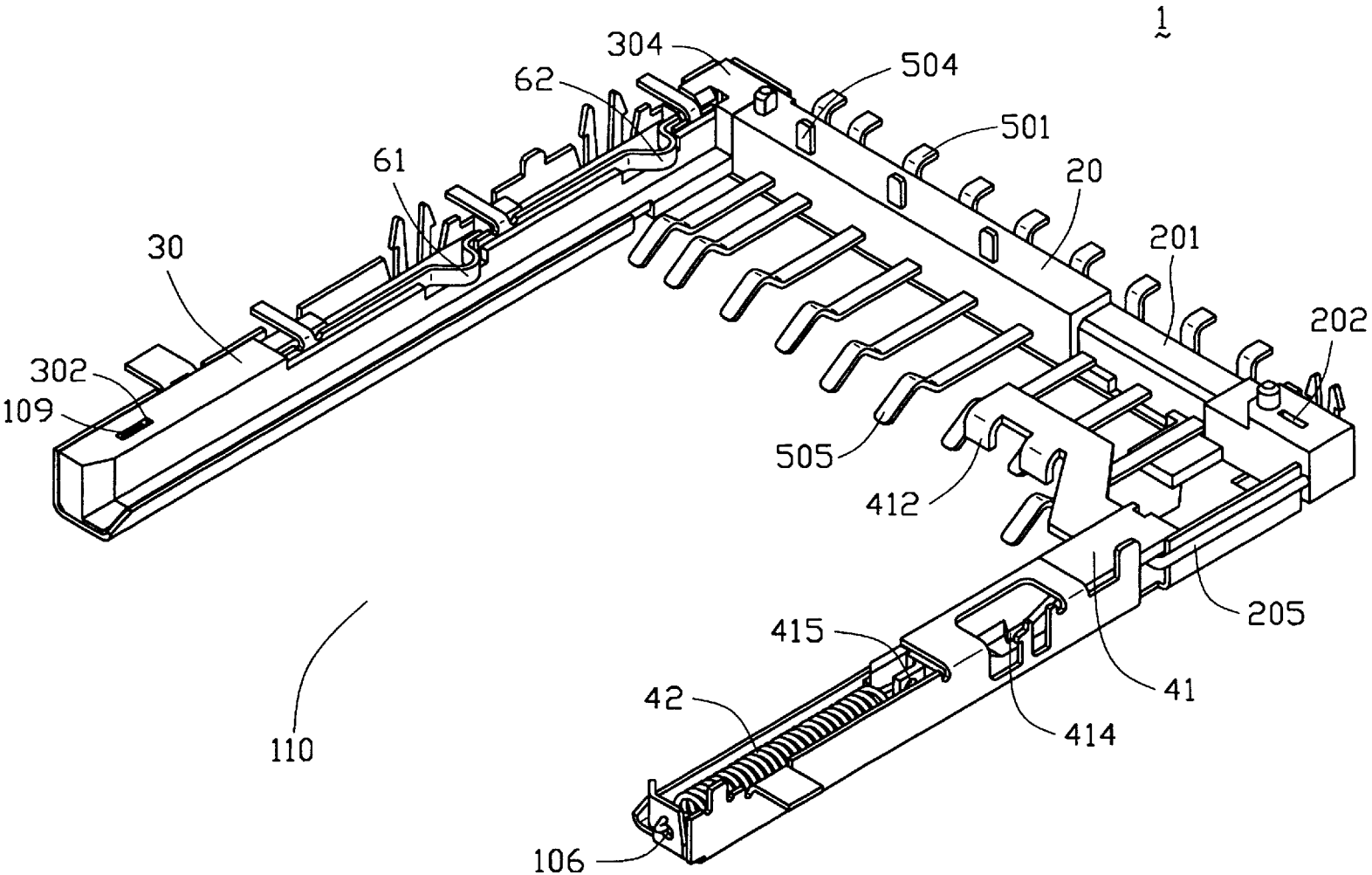
FIG. 2 is an assembled view of FIG. 1.
Figure 3:
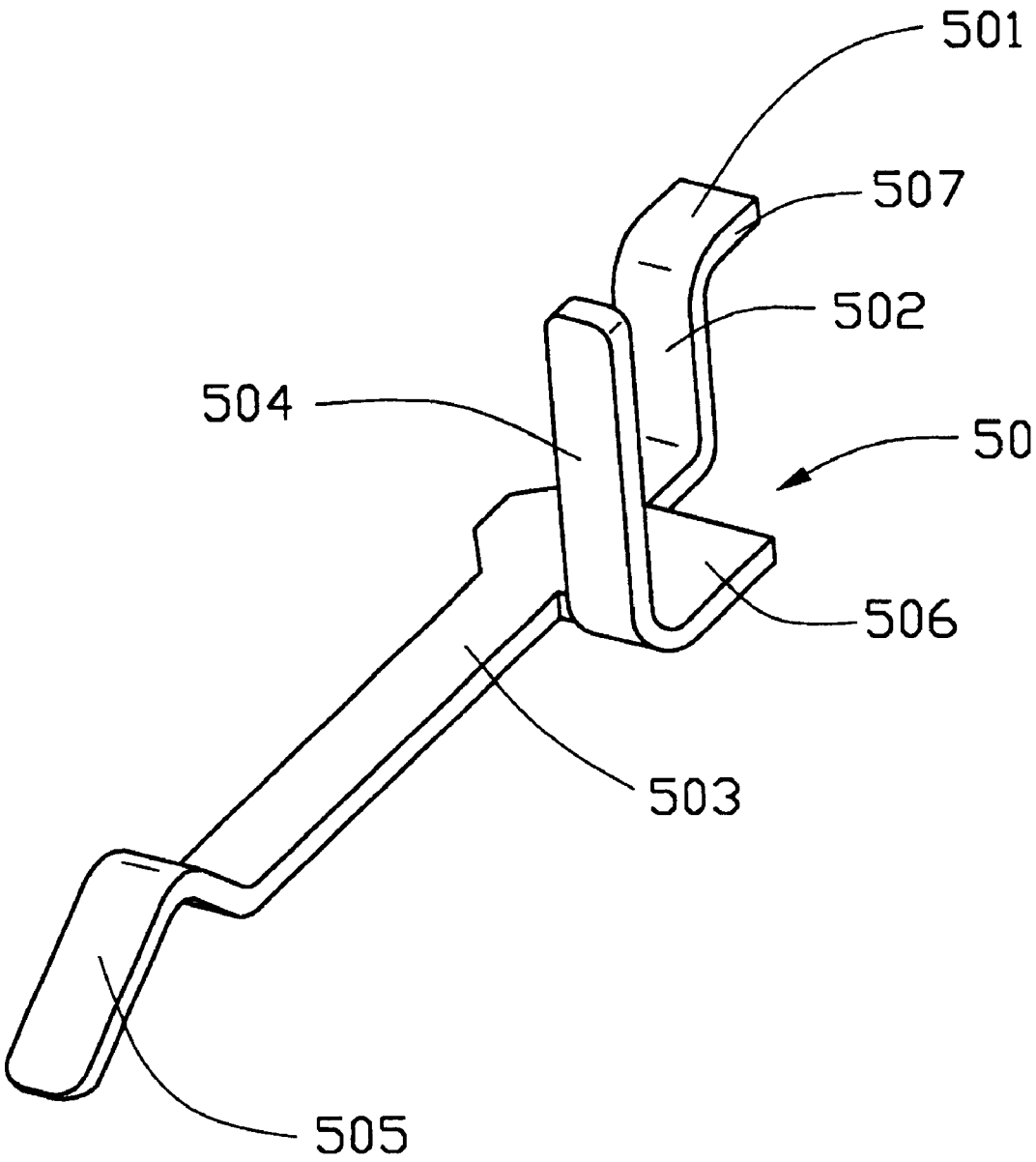
FIG. 3 is a perspective view of a terminal of the connector having a dip leg.
Figure 4:
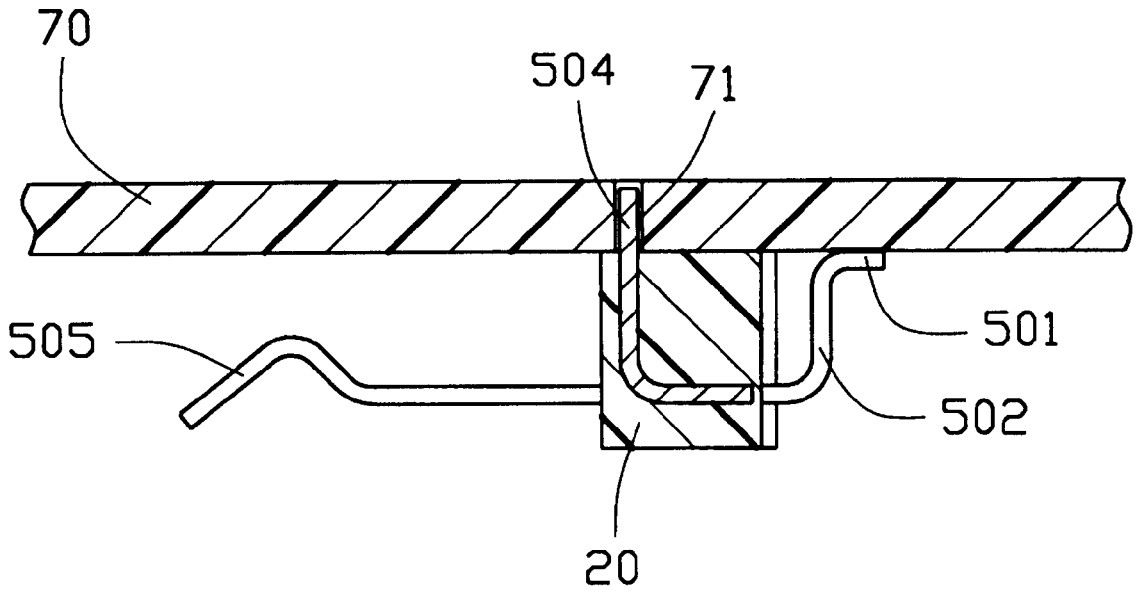
FIG. 4 is a cross-sectional view taken along line 4—4 in FIG. 1, showing the relationship between the terminal and a printed circuit board (PCB).

Referring to FIGS. 2, 3 and 4, each terminal 50 includes a planar mounting portion 503, a contact portion 505 projecting into the card-receiving cavity 110 for being horizontally exerted on by the card during its insertion, and a tail portion 501 projecting rearwardly from the mounting portion 503 for being surface mounted to the PCB 70. Each mounting portion 503 has a molding section 506 molded in the transverse base 20. Each tail portion 501 includes a vertical section 502 extending upwardly from a rear end of the mounting portion 503 and a solder section 507 extending rearwardly from a free end of the vertical section 502 for being surface mounted to the PCB 70. At least one of the terminals 50 has a dip leg 504 projecting from the molding section 506 and out of the transverse base 20 for being secured to a printed circuit board (PCB) 70. Each dip leg 504 is inserted into or soldered in a corresponding aperture 71 of the PCB 70.

Still referring to FIG. 1, the ejector 40 includes an ejection element 41 and a spring element 42. The ejection element 41 includes a body 413 and an ejection tab 412 projecting transversely from a rear end of the body 413. A notch 411 is recessed on a top surface of the body 413. A barb 414 projects from an inner side face of the notch 411.

The switch contacts include a write-protect switch contact 61, a full-insertion switch contact 62 and a third switch contact 63.

During manufacturing, the terminals 50 are molded with the transverse base 20 in juxtaposition. The molding section 506 and lower end portions of the dip legs 504 are molded in the transverse base 20.

In assembly, the transverse base 20 together with the terminals 50 are mounted on a transverse portion of the U-shaped frame 102. The longitudinal base 30 is mounted in the mounting channel 101 of the shell 10 with the strap 304 joining to the protrusion 204. The hooks 109 are respectively fitted in the first and the second slit 202, 302, thereby securing the transverse base 20 and the longitudinal base 30 to the shell 10. The ejection element 41 is mounted in the ejection channel 108. The L-shaped latching leg 205 engages a rear wall face of the notch 411. Two free ends of the spring element 42 respectively lock with a first aperture 415 of the ejection element 41 and a second aperture 106 in a front end of the shell 10. The switch contacts 61, 62, 63 are arranged in the longitudinal base 30 orderly with positioning tabs (not labeled) respectively fitted in positioning slits (not shown) of the longitudinal base 30. The write-protect switch contact 61 is located ahead of the contact portion 505 of the terminal 50. The full-insertion switch contact 62 and the third switch contact 63 are located behind the contact portion 505 of the terminal 50. The write-protect switch contact 61 contacts the full-insertion switch contact 62 and the full-insertion switch contact 62 contacts the third switch contact 63. Each tail portion 501 of the terminals 50 is surface mounted on the PCB 70, and each dip leg 504 is fitted or soldered in a corresponding aperture 71 of the PCB 70, thereby restricting a horizontal resilient movement of the transverse base 20.

During operation, the card slides over the connector 1. The card with write-protect on initiates the write-protect switch contact 61, and the write-protect switch contact 61 disengages from the full-insertion switch contact 62. The card moves rearwardly and touches the ejection tab 412 of the ejection element 41. The ejection element 41 is activated and moves with the card and the spring element 42 being lengthened. The card moves on to engage with the contact portions 505 of the terminals 50. The latching leg 205 locks with the barb 414 of the ejection element 41. The card reaches its final position in the connector 1, and initiates the full-insertion switch contact 62. The full-insertion switch contact 62 disengages from the third switch contact 63. The ejection tab 412 of the ejection element 41 engages the indentation 201 of the transverse base 20. Exerting a rearward force on a front edge of the card, the locking leg 205 disengages from the barb 414. The ejection tab 412 moves forwardly by the restoring force of the spring element 42, thereby pushing the card out.

It is to be understood, however, that even though numerous, characteristics and advantages of the present invention have been set forth in the foregoing description, together with details of the structure and function of the invention, the disclosed is illustrative only, and changes may be make in detail, especially in matters of shape, size, and arrangement of parts within the principles of the invention to the full extent indicated by the broad general meaning of the terms in which the appended claims are expressed.

What is claimed is:

1. A card connector (1) comprising:

an insulative transverse base (20);

a plurality of terminals (50) retained in said transverse base (20);

each of said terminals (50) including:

an elongated planar mounting portion (503) with a molding section (506) embedded within the base (20);

a contact portion (505) curvedly extending forwardly from a front portion of said mounting portion (503);

a tail portion (501) disposed on a rear portion of said mounting portion (503), said tail portion (501) including a vertical section (502) vertically extending from said rare portion of said mounting portion (503), and a solder section (507) horizontally rearwardly extending from a distal end of said vertical section (502);

a write-protect switch contact (61), a full-insertion switch contact (62) and a third switch contact (63) mounted in the longitudinal base (20); and an ejector (40) mounted in a longitudinal side of the shell (10), the ejector (10) including an ejection element (41) and a spring element (42) flexibly connecting the ejection element (41) with the shell (10); and a dip leg (504) vertically extending from said molding section (506) in the same direction as said vertical section (502); wherein said dip leg (504) is parallel to said vertical section (502) and is spaced from said mounting portion (503) in a lateral direction; wherein the ejection element (41) includes a body (413), an ejection tab (412) projecting transversely from a rear end of the body (413), and a notch (411) recessed in a top surface of the body (413), a barb (414) projecting from an inner side of the notch (411), and wherein a latching leg (205) projects forwardly from a side of the transverse base (20) for locking with the ejection element (41) to facilitate ejection of the card.

* * * * *